US006634117B2

(12) United States Patent
Gmeiner et al.

(10) Patent No.: US 6,634,117 B2
(45) Date of Patent: Oct. 21, 2003

(54) METHOD FOR DRYING AN ACTIVE PART AND DEVICE FOR CARRYING OUT THIS METHOD

(75) Inventors: Paul Gmeiner, Oberwil-Lieli (CH); Peter Keller, Zürich (CH)

(73) Assignee: Micafil AG, Zurich (CH)

( * ) Notice: Subject to any disclaimer, the term of this patent is extended or adjusted under 35 U.S.C. 154(b) by 0 days.

(21) Appl. No.: 10/122,231

(22) Filed: Apr. 16, 2002

(65) Prior Publication Data

US 2002/0174563 A1 Nov. 28, 2002

(30) Foreign Application Priority Data

Apr. 24, 2001 (EP) ..... 01810399

(51) Int. Cl.[7] ..... F26B 3/34

(52) U.S. Cl. ..... 34/246; 34/350; 34/357; 34/348; 219/209

(58) Field of Search ..... 219/209; 34/343, 34/348, 350, 357, 246

(56) References Cited

U.S. PATENT DOCUMENTS

| | | | | |
|---|---|---|---|---|
| 3,195,044 A | * | 7/1965 | Flanagan | 324/703 |
| 3,373,500 A | * | 3/1968 | Winter | 34/246 |
| 4,369,353 A | * | 1/1983 | Duenke | 219/492 |
| 5,131,167 A | * | 7/1992 | Bachmann et al. | 34/246 |
| 5,424,513 A | | 6/1995 | Gmeiner et al. | |

FOREIGN PATENT DOCUMENTS

| | | |
|---|---|---|
| CH | 633 633 | 12/1982 |
| DE | 3715235 A1 | 11/1988 |
| DE | 37 15 235 | 11/1988 |
| DE | 195 01 323 A1 | 7/1996 |
| DE | 19501323 A1 | 7/1996 |
| DE | 196 37 313 A1 | 3/1997 |
| EP | 0752567 A1 | 1/1997 |
| EP | 0801405 A2 | 10/1997 |
| JP | 56107548 | 8/1981 |
| WO | 02/20113 A1 | 3/2002 |

OTHER PUBLICATIONS

W. Muntener, "LFH—Trocknung: Erfahrungen und Trends", Symposium Stuttgart, Technical Paper, pp. 1–14.

* cited by examiner

*Primary Examiner*—Ira S. Lazarus
*Assistant Examiner*—Andrea M. Ragonese
(74) *Attorney, Agent, or Firm*—Burns, Doane, Swecker & Mathis, L.L.P.

(57) ABSTRACT

The method serves for drying an active part containing at least one winding and solid insulations. The active part is arranged in a vacuum-tight housing and is heated there to a final temperature value ($T_{fin}$) by means of warmed oil and by means of a current (I) carried in the winding. The warmed oil is sprayed in the housing at reduced pressure (p) and with the current (I) switched on. At the same time, water is extracted from the active part. The sprayed oil is collected on the housing bottom, after discharging heat to the active part, and, after rewarming, is sprayed once again in the housing at reduced pressure and with the current switched on. The active part is thus dried particularly quickly and carefully.

10 Claims, 2 Drawing Sheets

METHOD FOR DRYING AN ACTIVE PART AND DEVICE FOR CARRYING OUT THIS METHOD

FIELD OF THE INVENTION

The invention proceeds from a method for drying an active part containing at least one winding and solid insulations, according to the preamble of patent claim 1. In this case, the active part is arranged in a vacuum-tight housing and, by oil being sprayed in the housing and by means of a current carried in the at least one winding, is heated to a final temperature value determined by the temperature of the winding. At a pressure which is reduced in relation to atmospheric pressure, water is extracted from the heated active part.

If process management is appropriate, a perfectly dried active part is achieved by means of the generic method.

BACKGROUND OF THE INVENTION

A method of the type initially mentioned is described in DE 195 01 323 A1. In this method, in a vacuum-tight housing, the windings of a transformer are heated to a desired temperature, and dried, by means of current and, in parallel with this, by warmed oil being sprayed in. The oil is sprayed first at atmospheric pressure and then, in a variant of the method, at a pressure which is gradually reduced. By the pressure being lowered typically to 200 mbar, the degassing and dewatering of the windings are improved.

A further method for drying solid insulations was presented by W. Müntener/of the company Micafil AG, Zurich, Switzerland, at a symposium held in 1999 in Stuttgart/FRG on the subject "LFH—Trocknung: Erfahrung und Trends" ["LFH—Drying: Experience and Trends"]. In this method, an active part of a transformer arranged in the field and filled with oil is dried. For this purpose, a mobile LHF plant (LFH=Low Frequency Heating) is connected to the high-voltage windings of the transformer which are contained in the active part. The low-voltage windings are short-circuited. The transformer housing is connected to an oil preparation plant and to a vacuum plant.

For drying, the active part is first heated by means of a low-frequency current delivered from the LFH plant and by means of transformer oil, the oil being warmed and circulated via the oil preparation plant.

When the active part is heated to a predetermined desired temperature, the hot transformer oil is removed from the transformer housing and the pressure in the transformer housing is reduced in relation to atmospheric pressure in accordance with Paschen's Law. During the lowering of pressure, intensive evaporation of the water present in the solid insulations of the active part takes place. At the same time, as a function of the pressure inside the transformer housing and of the height of the temperature of the high-voltage and/or low-voltage winding, the magnitude of the current is changed, in order thereby to achieve careful reheating and consequently a permanent evaporation of the water from the insulations.

In this method and in the method according to DE 195 01 323 A1, an effective extraction of the water occurs only when the active part is heated to the predetermined desired temperature and the housing pressure is lowered well below atmospheric pressure after the removal of the oil.

SUMMARY OF THE INVENTION

The object of the invention, as specified in the patent claims, is to provide a method of the type initially mentioned, which allows rapid and particularly careful drying, and to specify a device for carrying out this method which can be produced in a simple way.

In the method according to the invention, before the spraying of the warmed oil, the pressure in the housing is reduced to a working value which is higher than a desired pressure value determined by Paschen's Law and lower than an upper pressure limit value which, in relation to atmospheric pressure, ensures a high evaporation rate of the water from the active part. Moreover, at the working value, the oil is sprayed in the housing, with the current switched on, and, during the spraying of the oil, the collection of the sprayed oil on the housing bottom and also the rewarming and renewed spraying of the collected oil, the temperature of the winding is kept higher than the temperature of the oil. The active part is thus dried intensively even at the commencement of the heating operation. At this moment, the active part is located in a virtually oil-free evacuated housing in which it is effectively heated by the spraying of the previously warmed oil and by means of LFH heating. The method is therefore particularly quick.

Since, even at relatively low temperatures, the water initially present in the hygroscopic solid insulations of the active part to be dried is removed from the insulations, and, since the active part is heated from inside via the current-carrying winding and at the same time from outside via the sprayed oil, the drying operation is carried out not only rapidly, but at the same time also carefully. A reduction in the dielectric properties of the solid insulations by polymerization is thereby largely ruled out. Since the temperature of the oil is kept below the temperature of the winding arranged inside the active part, the internal parts of the insulations of the active part are warmed up to a greater extent than the external parts exposed to the oil. The water to be removed from the active part is therefore led outward from inside the active part particularly quickly by virtue of diffusion operations.

On account of the rapid drying operation and the small quantity of oil, the incidence of energy is comparatively low and the method according to the invention can be carried out in a highly efficient way. This is also, above all, because, owing to the small oil quantity, a plant carrying out the preparation and warming of the oil can be kept small.

In order to rule out damage to the active part with sufficient reliability, the reduced pressure in the housing is maintained, during the spraying of the oil and heating of the winding by means of current, above a desired pressure value determined by means of Paschen's Law.

An effective control of the drying method according to the invention is possible when, during the heating of the active part, the quantity of water emerging from the active part per unit time is detected, for example, by a measurement of the steam partial pressure in the housing, and when, below a maximum water quantity emerging per unit time, the winding temperature is kept constant, above all by the spraying of oil. With the current switched off, the reduced pressure can then be lowered below the desired pressure value and drying can then be carried out in a particularly effective and energy-saving manner. In order to improve the degree of drying, it is recommended to raise the pressure to a value above the desired pressure value and to increase the winding temperature successively to a final temperature value as soon as the water quantity occurring per unit time has fallen below a limit value.

The drying quality may additionally be increased when, after the spraying of oil, the oil is removed from the housing at reduced pressure and the winding temperature is at the same time kept constant by heating with current. By means of periodic lowering of the reduced pressure below the desired pressure value, with the current switched off, even small water residues can then still be removed from the active part.

A suitable device for carrying out the method according to the invention has an oil preparation plant for drawing off the oil collected on the housing bottom, for warming the drawn-off oil and for supplying the collected oil, and also a spray device which is arranged in the ceiling of the housing and which is connected to a line supplying warmed oil from the preparation plant. The oil is thus sprayed onto the active part from above and can then discharge a large amount of heat over a relatively long flow path. Since the spray device has a plurality of spray nozzles which are distributed over the ceiling and are oriented toward the active part and which are advantageously designed adjustably, the oil can be sprayed in a specific way and the efficiency of the device thereby additionally increased.

BRIEF DESCRIPTION OF THE DRAWINGS

An exemplary embodiment of the invention is illustrated in simplified form in the drawings in which.

DETAILED DESCRIPTION OF THE INVENTION

Figure 1:
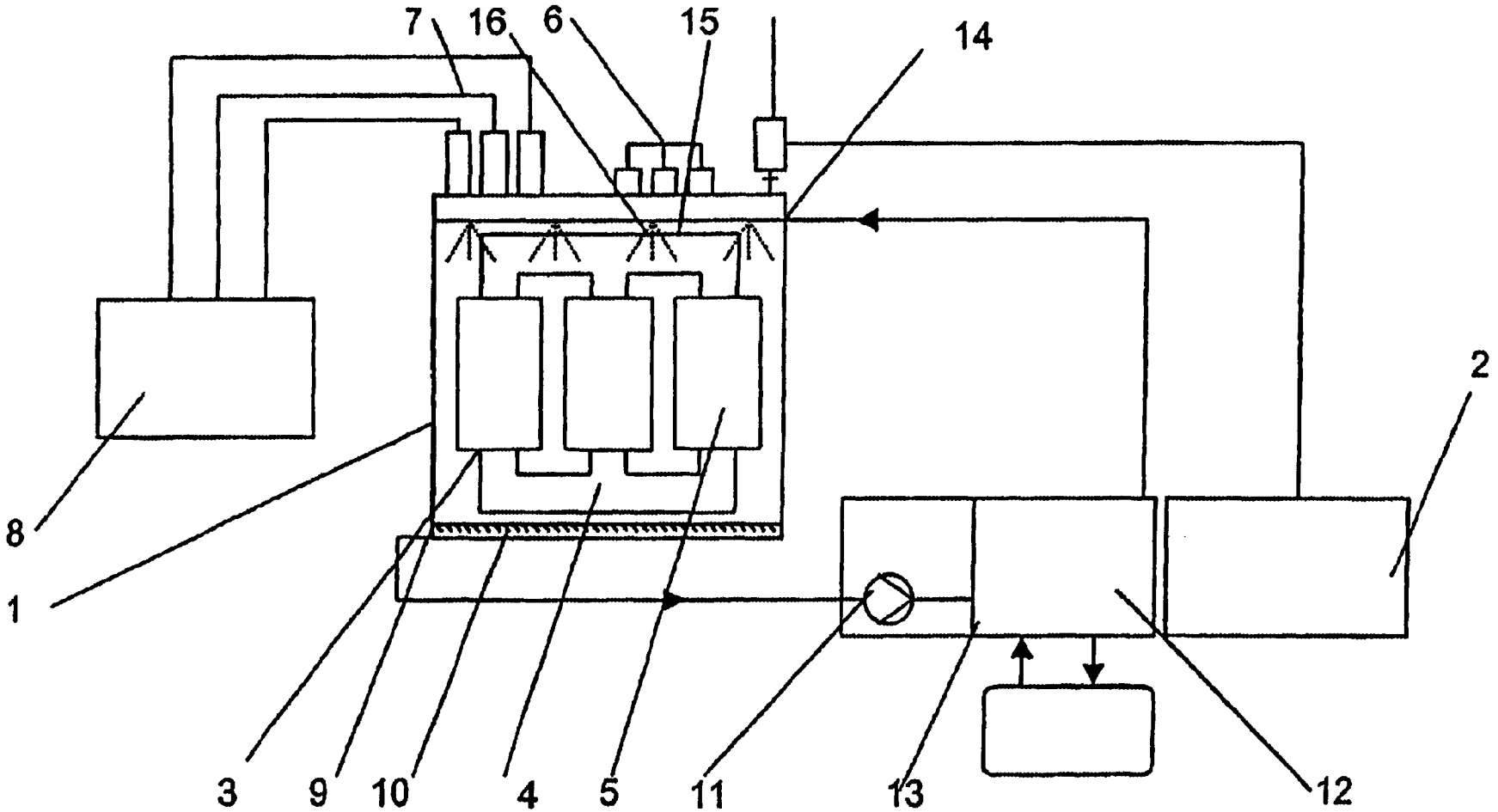
FIG. 1 shows a block diagram of a device for carrying out the method according to the invention, with a housing receiving an active part of an electrical appliance, with an LFH plant, with an oil preparation plant and with an oil spray device.

In all the figures, the same reference symbols refer to identically acting parts. In the device, illustrated in FIG. 1, for carrying out the method according to the invention, 1 designates a vacuum-tight housing which can be connected to a vacuum plant 2 via a valve arrangement which is not designated. The housing receives an active part 3 of an electrical appliance, for example a transformer. If the transformer is oil-filled, the transformer housing can then serve as the housing 1. However, the housing may also be any other vacuum-tight temperature-resistant container, with vacuum-tight current leadthroughs, and can also receive a plurality of small active parts instead of one large active part.

The active part 3 contains at least one winding and hygroscopic solid insulations which insulate the winding. The active part evident from FIG. 1 contains, furthermore, an iron core 4 and three coil blocks 5 which are assigned in each case to a phase of a three-phase current and which in each case have a high-voltage and a low-voltage winding. The low-voltage windings 6 are short-circuited outside the housing, whereas the high-voltage windings 7 are connected to the current output of an LFH plant 8 arranged outside the housing 1 and generating low-frequency alternating current or direct current.

Provided in the bottom of the housing 1 is an outflow 9, through which oil 10 collected on the housing bottom can be drawn off with the aid of an oil feed pump 11 into an oil heater 12 of an oil preparation plant 13. The outlet of the oil heater 12 is connected via an oil inlet 14 to a spray device 15 arranged in the ceiling of the housing 1. This spray device has a plurality of spray nozzles 16 which are distributed over the ceiling and are oriented toward the active part. At least some of the spray nozzles 16 may also be arranged on the side walls of the housing 1. As a result, and by means of adjustably oriented spray nozzles, the active part 3 can be sprayed in a specific way, not only from above, but also from the side.

Figure 2:
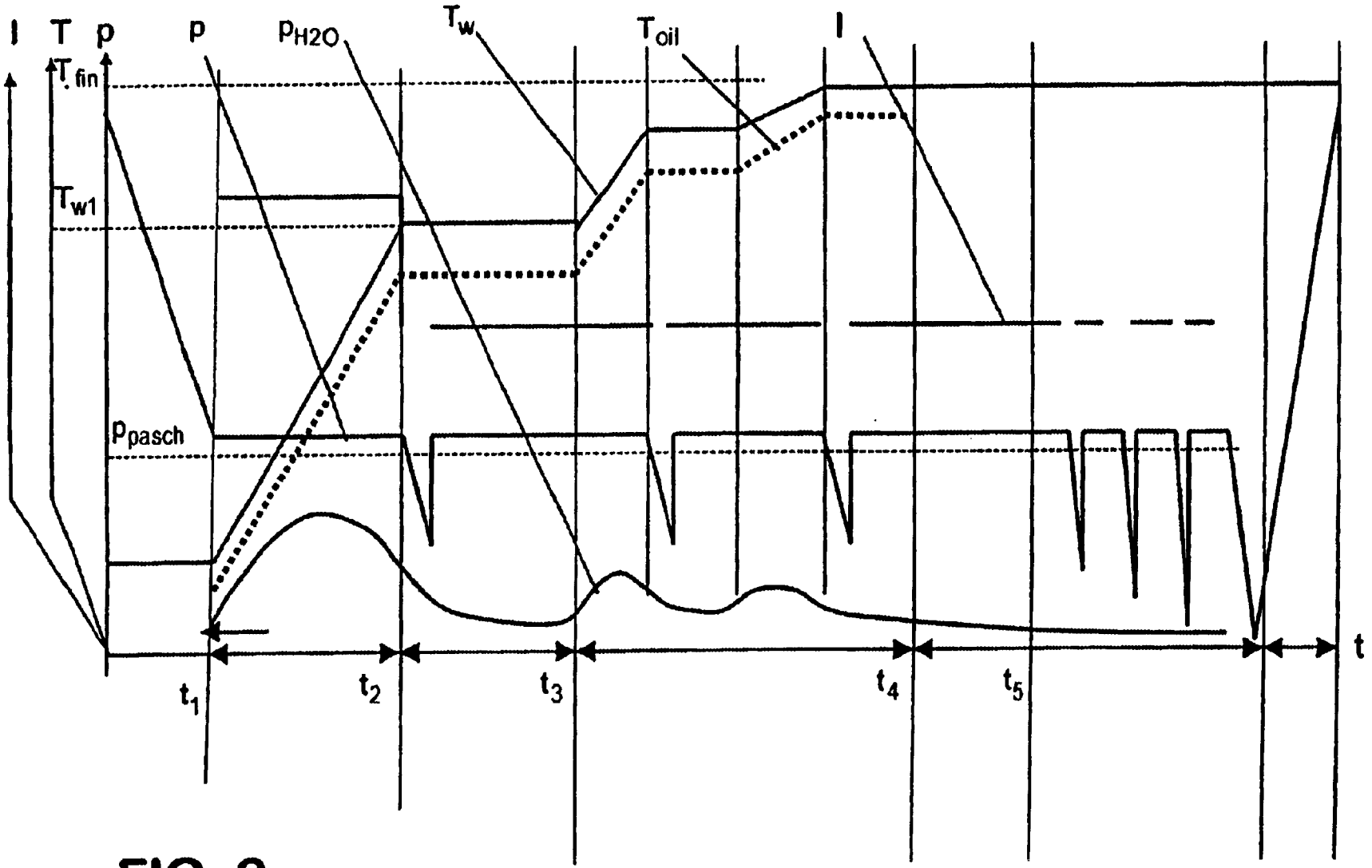
FIG. 2 shows a graph which illustrates as a function of time important parameters of the method according to the invention, such as the temperatures $T_{oil}$ of the oil to be sprayed and $T_w$ of a winding of the active part, the total pressure p in the housing, the steam partial pressure $p_{H20}$ in the housing and the current I delivered by the LFH plant.

The action of this device is explained in more detail with reference to FIG. 2: in the housing 1 loaded with the active part 3, the pressure p is first reduced by means of the vacuum plant 2. The working value of the reduced pressure, this working value being used to carry out the method, should be higher than a desired pressure value $p_{pasch}$ predetermined by Paschen's Law. Below this desired pressure value, by virtue of Paschen's Law, flashovers could occur in an electrical field. When a heating voltage is applied to the active part, electrical discharges could then arise, which could result in the insulating capacity of the active part being impaired. The working value of the reduced pressure should also be as low as possible, however, in order to have a high evaporation rate for the water to be removed from the active part. The working value is below 100 mbar, typically around 10 to 30 mbar.

At a time point $t_1$, the pressure is sufficiently reduced. The active part is then heated by means of a low-frequency alternating current I carried by the high-voltage windings 7 and by means of an induction current generated in the low-voltage windings 6. At the same time, oil warmed in the oil preparation plant 13 is guided to the spray device 15 and from there is sprayed onto the surface of the active part 3. What is achieved by the combined heating by current and by oil is that the heat necessary for drying the active part is supplied simultaneously from the inside and from the outside.

Particularly rapid and careful drying is thereby achieved. Water bound in the solid insulations is guided away from the heated windings outward onto the surfaces of the solid insulations and is evaporated. Since the active part 3 is exposed to a reduced pressure during heating, the water can evaporate from the active part 3 even at the commencement of the heating operation. The water quantity evaporating per unit time is determined indirectly via a measurement of the steam partial pressure and is illustrated in FIG. 2 as the curve $p_{H20}$. At the same time, the temperatures $T_{oil}$ of the sprayed oil and $T_w$ of the windings of the active part 3 are also detected. While the oil temperature $T_{oil}$ is determined directly by means of a temperature sensor, the winding temperature $T_w$ is based on an average value calculated in a known way from the temperatures of the high-voltage and low-voltage winding (cf., for example, the prior art according to W. Müntener initially cited). The corresponding temperature curves are likewise plotted in FIG. 2. As can be seen, during the drying process, $T_w$ is always kept somewhat higher than $T_{oil}$. This ensures that the water present in the active part 3 is led from the inside outward. The evaporated water is sucked away via the vacuum plant 2.

At the time point $t_2$, the winding temperature $T_{w1}$ is already relatively high and is no longer very far (for example, 10 or 20° C.) below a permissible final temperature value $T_{fin}$ of, for example, 110° C. Since, at this temperature, $p_{H20}$ has exceeded a maximum water quantity discharged per unit time, at this time point the winding temperature $T_w$ is kept constant at $T_{w1}$. The oil temperature is also kept constant. Keeping constant may be brought about predominantly by the spraying of oil. It is recommended, however, also to heat intermittently by means of current, since, on the one hand, this then ensures that $T_w$ is always above $T_{oil}$ and the water in the active part diffuses from the inside outward, and since, on the other hand, during a current intermission, the pressure p can then be lowered below the desired pressure value $T_{pasch}$ and the water led outward can be evaporated more effectively from the active part.

At the time point $t_3$, there is no longer very much water. Consequently, from this time point on, at a pressure p which is above the desired pressure value $p_{pasch}$, the oil temperature and the winding temperature are increased successively. During each temperature increase, a comparatively large water quantity initially occurs. After a maximum is exceeded, the oil and winding temperatures are in each case kept constant again, and, in the case of an intermittent heating current I, the pressure p is lowered below the desired pressure value $p_{pasch}$ in current intermissions.

At the time point $t_4$, the final temperature $T_{fin}$ is reached, and the heating is set by the spraying of oil. The active part is maintained at the final temperature by current heating. At a pressure which is above the desired pressure value $p_{pasch}$, the oil 10 is then drawn off from the housing 1 completely. At the same time as the oil is drawn off, impurities flushed away from the active part by the oil are also removed from the housing.

At the time point $t_5$, the oil is removed. Residual water can then still be removed from the active part in a subsequent fine vacuum phase by intermittent heating and pressure lowering. Finally, with the electrical heating switched off, the housing can be ventilated, and the dried active part can be extracted or fresh oil can be introduced into the housing.

List of Reference Symbols

1 Housing
2 Vacuum plant
3 Active part
4 Iron core
5 Coil block
6 Low-voltage winding
7 High-voltage winding
8 LFH plant
9 Outflow
10 Oil
11 Oil feed pump
12 Oil heater
13 Oil preparation plant
14 Oil inlet
15 Spray device
16 Spray nozzles
I Current of an LFH plant
p Total pressure
$p_{H20}$ Steam partial pressure
$p_{pasch}$ Desired pressure value
T Temperature
$T_{fin}$ Final temperature value
$T_w$ Winding temperature
$T_{w1}$ Constant winding temperature
$T_{oil}$ Oil temperature
t Time
$t_1$, $t_2$, $t_3$, $t_4$, $t_5$ Time points

What is claimed is:

1. A method for drying an active part containing at least one winding and solid insulations, in a vacuum-tight housing, comprising the steps of:

a. reducing the pressure in the housing to a working value, wherein the working value is higher than a desired pressure determined by Paschen's Law and lower than an upper pressure limit value, which in relation to atmospheric pressure, ensures a high evaporation rate of water from the active part;

b. extracting water from the active part from the reduction of pressure in the housing;

c. switching on current to be carried in the at least one winding;

d. spraying warmed oil in the housing;

e. heating the active part to a final temperature value by the warmed oil being sprayed and the current being carried in the at least one winding;

f. collecting the sprayed oil on the housing bottom;

g. reheating the collected oil;

h. recirculating the reheated oil by spraying the reheated oil at the working pressure; and i. maintaining the temperature of the winding at a higher temperature than the temperature of the oil.

2. The method as claimed in claim 1, wherein, during the spraying of the oil and heating of the winding by means of current, the reduced pressure in the housing is maintained above a desired pressure value determined by means of Paschen's Law.

3. The method as claimed in claim 1, wherein, during the heating of the active part, the quantity of water emerging from the active part per unit time is detected, and in that, below a maximum water quantity emerging per unit time, the temperature of the current-heated winding is kept constant.

4. The method as claimed in claim 3, wherein, at a constant winding temperature and with the current switched off, the reduced pressure is lowered below the desired pressure value.

5. The method as claimed in claim 4, wherein, below a limit value of the water quantity occurring per unit time, the pressure is raised to a value above the desired pressure value and the winding temperature is then increased successively to the final temperature value.

6. The method as claimed in claim 1, wherein, after the spraying of oil, the oil is removed from the housing at reduced pressure while the winding temperature is held constant by heating the at least one winding with current.

7. The method as claimed in claim 6, wherein, after the removal of the oil, the reduced pressure is lowered periodically below the desired pressure value, with the current switched off.

8. A device for carrying out the method as claimed in claim 1, with an oil preparation plant for drawing off the oil warmed on the housing bottom, for warming the drawn-off oil and for supplying the warmed oil, wherein in the ceiling of the housing, at least one spray device is provided which is connected to a line supplying warmed oil from the oil preparation plant.

9. The device as claimed in claim 8, wherein the spray device has a plurality of spray nozzles distributed over the ceiling and oriented toward the active part.

10. The device as claimed in claim 9, wherein the spray nozzles are designed to be adjustable.

* * * * *